US006241543B1

(12) United States Patent
Mai

(10) Patent No.: US 6,241,543 B1
(45) Date of Patent: Jun. 5, 2001

(54) TUBULAR LAMP ASSEMBLY

(76) Inventor: Chao-Lin Mai, No. 1, Alley 2, Lane 94, Po Ai Rd., Hsinchu City (TW)

( * ) Notice: Subject to any disclaimer, the term of this patent is extended or adjusted under 35 U.S.C. 154(b) by 0 days.

(21) Appl. No.: 09/649,508

(22) Filed: Aug. 29, 2000

(51) Int. Cl.[7] ..... H01R 33/02; H01R 33/08
(52) U.S. Cl. ..... 439/236; 439/425
(58) Field of Search ..... 439/236, 241, 439/242, 226, 227, 249, 250, 229, 425, 427, 232

(56) References Cited

U.S. PATENT DOCUMENTS 6,059,593 * 8/1998 Pasternak ..... 439/236

* cited by examiner

*Primary Examiner*—Brian Sircus
*Assistant Examiner*—Javaid Nasri

(74) *Attorney, Agent, or Firm*—Varndell & Varndell, PLLC

(57) ABSTRACT

A tubular lamp assembly is constructed to include a lamp body, and an electric plug connected to electric contact holes at one end of the lamp body, the electric plug including a housing, the housing having a rectangular front receiving chamber, a circular rear receiving hole, a partition wall separating the front receiving chamber from the rear receiving hole, a plurality of receptacle portions integral with one side of the partition wall, and a plurality of through holes through the partition wall and the receptacle portions, a blade holder block installed in the front receiving chamber of the housing, two metal blades installed in the blade holder block and extended out of the housing for connection to an electric socket to receive power supply, the metal blades each having a rear end terminating in two receiving tubes respectively plugged into the receptacle portions of the housing, and a coupler coupled between the housing and the lamp body, the coupler having metal contact pins inserted through the through holes on the partition wall of the housing and connected between the receiving tubes of the metal blades and the electric contact holes of the lamp body.

8 Claims, 17 Drawing Sheets

TUBULAR LAMP ASSEMBLY

BACKGROUND AND SUMMARY OF THE INVENTION

The present invention relates to a tubular lamp assembly, and more particularly to a simple structure of tubular lamp assembly, which is extendible and, has a low manufacturing cost.

FIGS. 16 and 17 show a tubular lamp assembly according to the prior art. This structure of tubular lamp assembly comprises an electric cable, the electric cable having an electric plug at one end and an end block at an opposite end, the end block having a plurality of plug holes at the rear side thereof and a collar around the periphery, a lamp body, the lamp body having a series of lamp tubes inside the shell thereof and a plurality of metal contact holes at one end of the shell, a coupler coupled between the end block of the electric cable and the lamp body, the coupler having a plurality of metal contact tubes axially extended from the front side thereof and respectively plugged into the plug holes of the end block and connected to respective contact wires of the electric cable and a plurality of metal contact pins axially extended from the rear side thereof and respectively connected to the metal contact tubes at one end and adapted for plugging into the metal contact holes of the lamp body, a clamping tube sleeved onto one end of the end block of the electric cable and one end of the lamp body to hold the coupler on the inside, and a chuck threaded onto the clamping tube to hold down the clamping tube on the end block and the lamp body. The structure of tubular lamp assembly is complicated, and therefore its manufacturing cost is high. Further, this structure of tubular lamp assembly cannot fit different length requirements.

The invention has been accomplished under the circumstances in view. It is one object of the present invention to provide a tubular lamp assembly, which has a simple structure. It is another object of the present invention to provide a tubular lamp assembly, which is easy to install. It is still another object of the present invention to provide a tubular lamp assembly, which is inexpensive to manufacture. It is still another object of the present invention to provide a tubular lamp assembly, which is detachable. According to one aspect of the present invention, the tubular lamp assembly is comprised of a lamp body, and an electric plug detachably connected to electric contact holes at one end of the lamp body. According to another aspect of the present invention, the electric plug is comprised of a housing, a blade holder block mounted in the housing at one side to hold a pair of metal blades, and a coupler mounted in the housing at an opposite side and electrically connected to the metal blades and adapted for plugging into the electric contact holes of the lamp body. In an alternate form of the present invention, the tubular lamp assembly is comprised of a lamp body, and an electric socket detachably connected to electric contact holes at one end of the lamp body.

DETAILED DESCRIPTION OF THE PREFERRED EMBODIMENT

Figure 1:
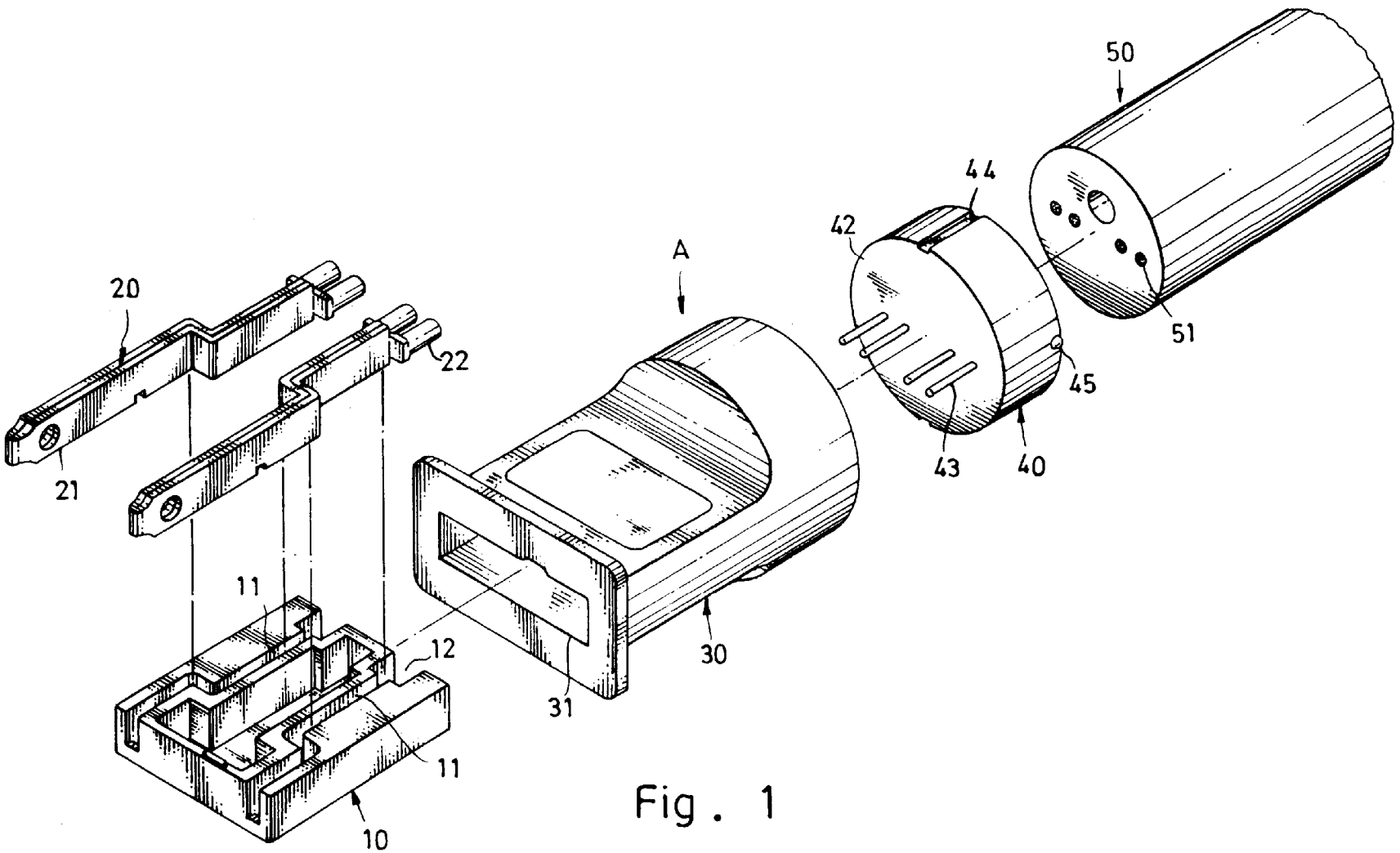
FIG. 1 is an exploded view of a tubular lamp assembly according to one embodiment of the present invention.
Figure 2:
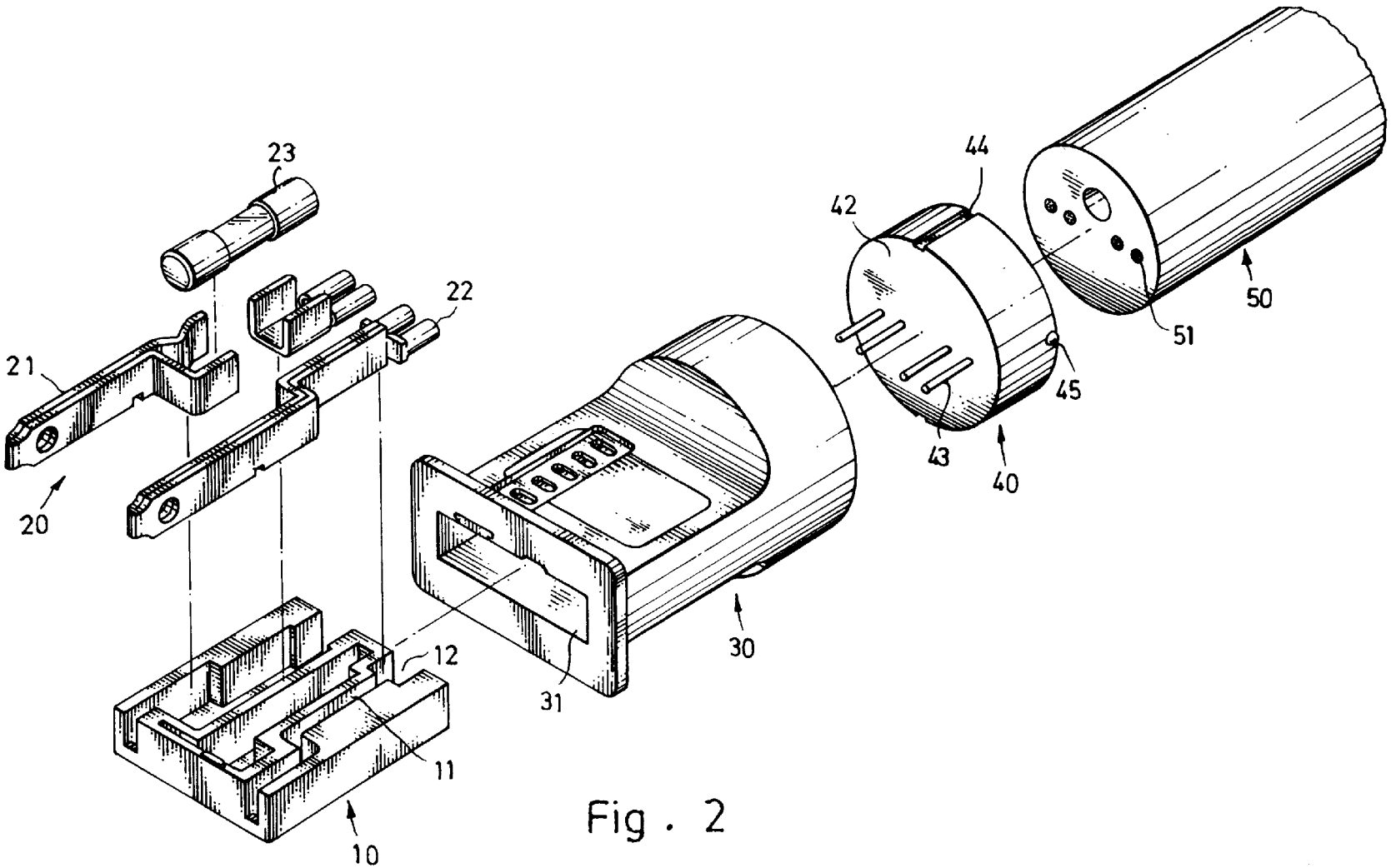
FIG. 2 is similar to FIG. 1 but showing one cartridge fuse provided.
Figure 3:
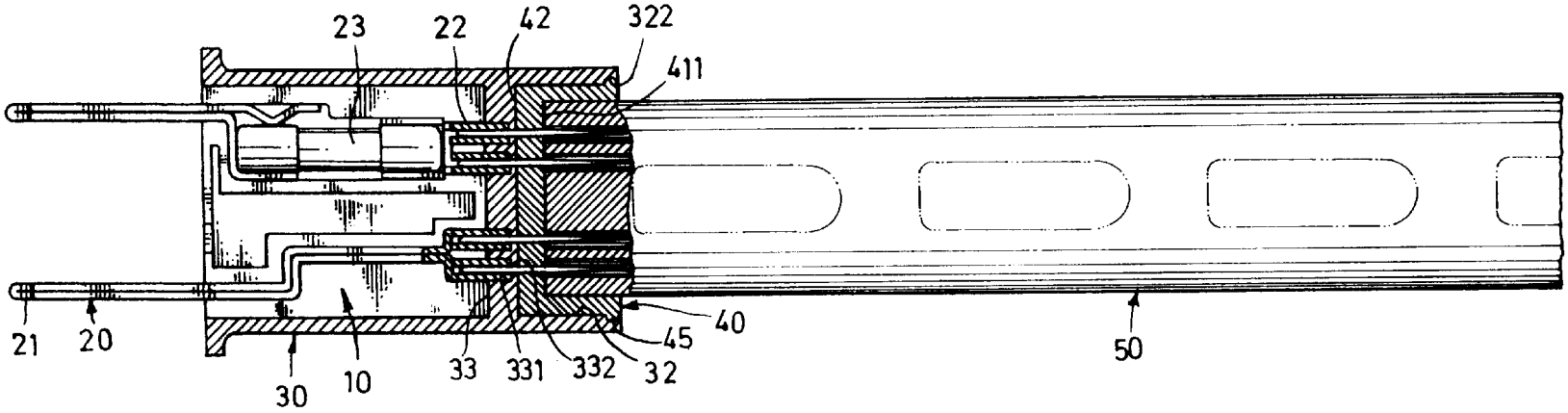
FIG. 3 is a sectional assembly view of the embodiment shown in FIG. 2.
Figure 4:
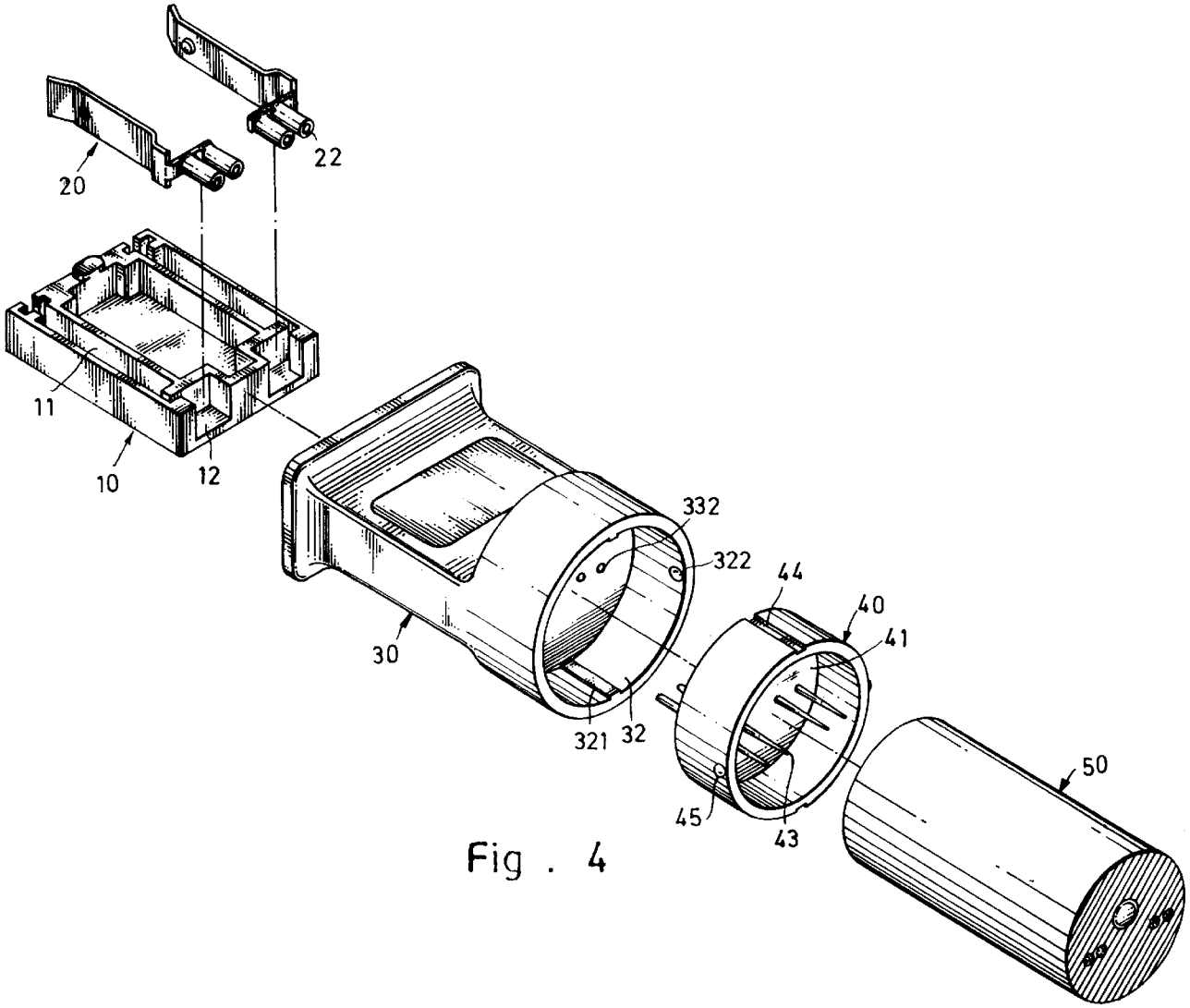
FIG. 4 is another exploded view of the embodiment shown in FIG. 1 when viewed from another angle.
Figure 5:
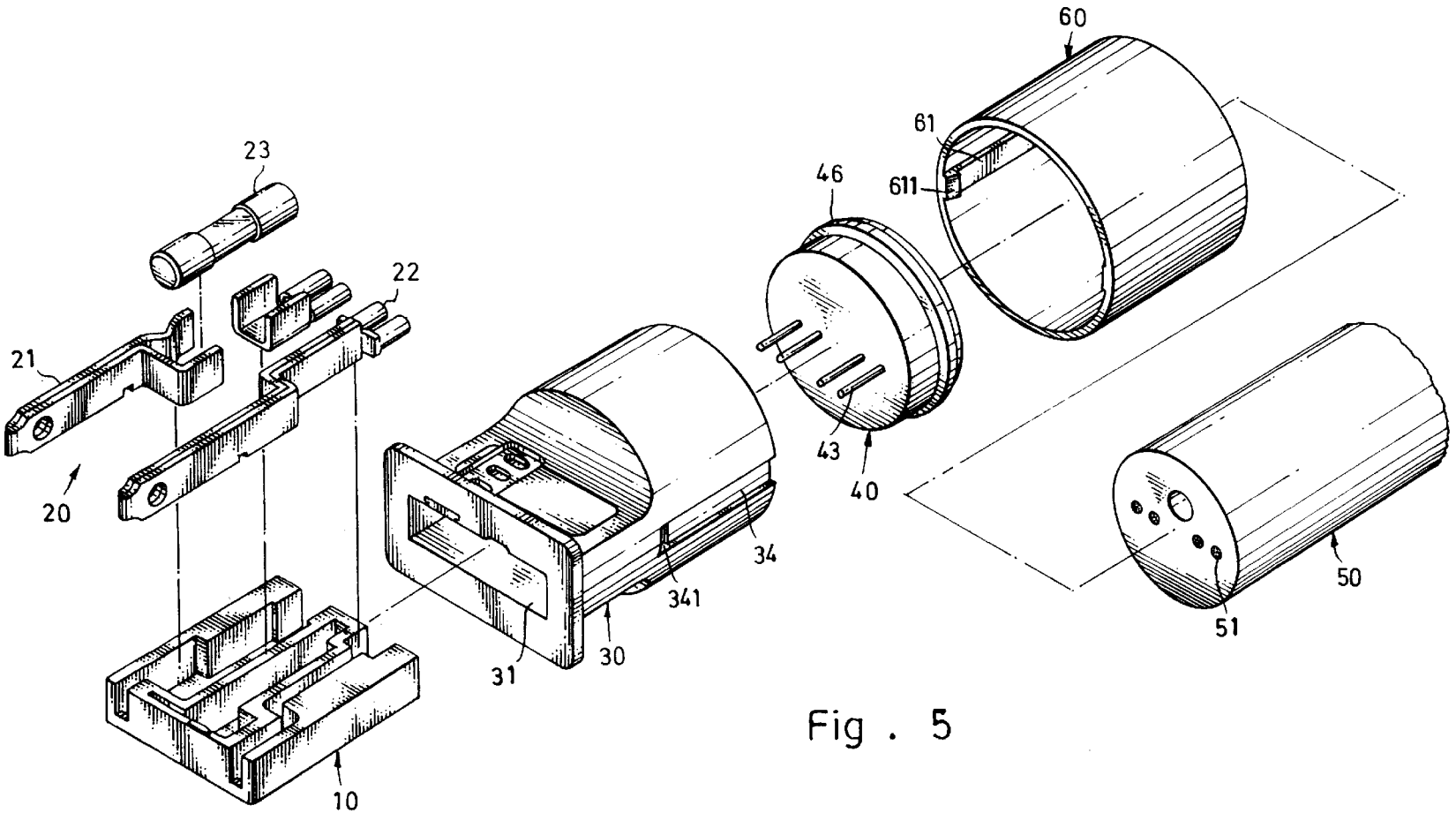
FIG. 5 is an exploded view of an alternate form of the tubular lamp assembly according to the present invention.
Figure 6:
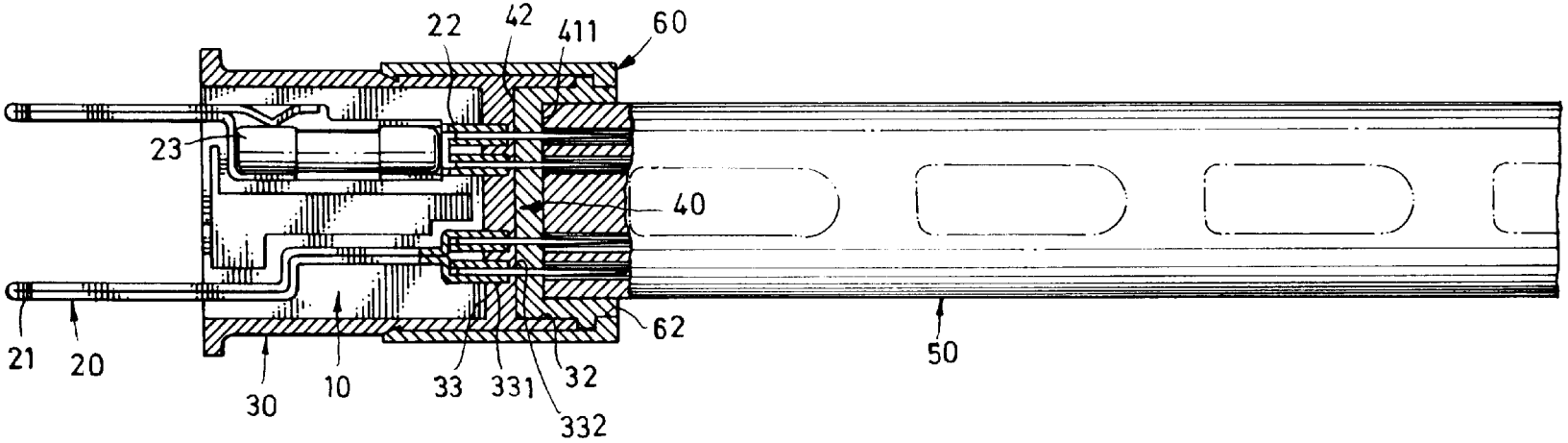
FIG. 6 is a sectional assembly view of the embodiment shown in FIG. 5.
Figure 7:
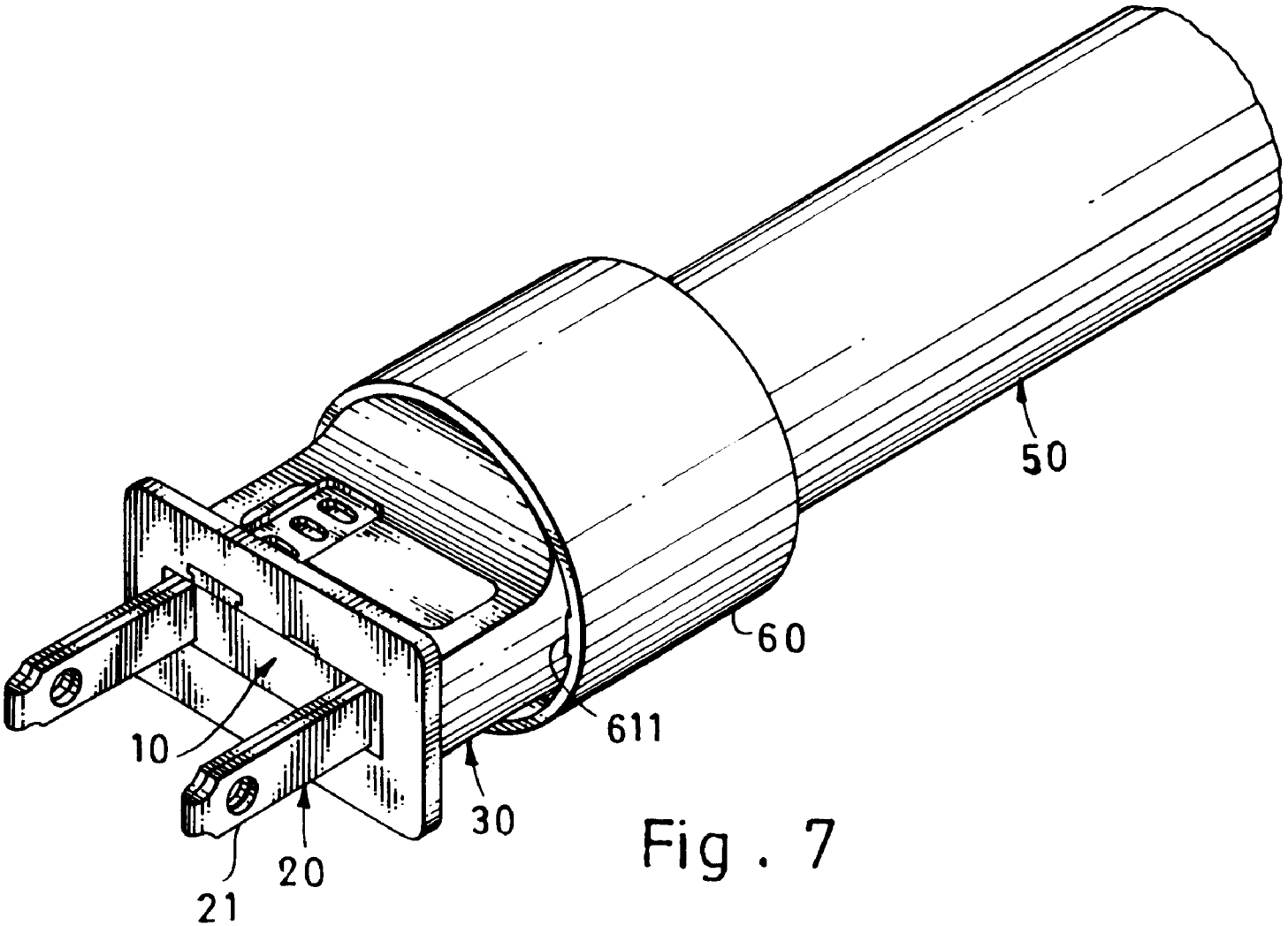
FIG. 7 is an elevational assembly view of the embodiment shown in FIG. 5.
Figure 8:
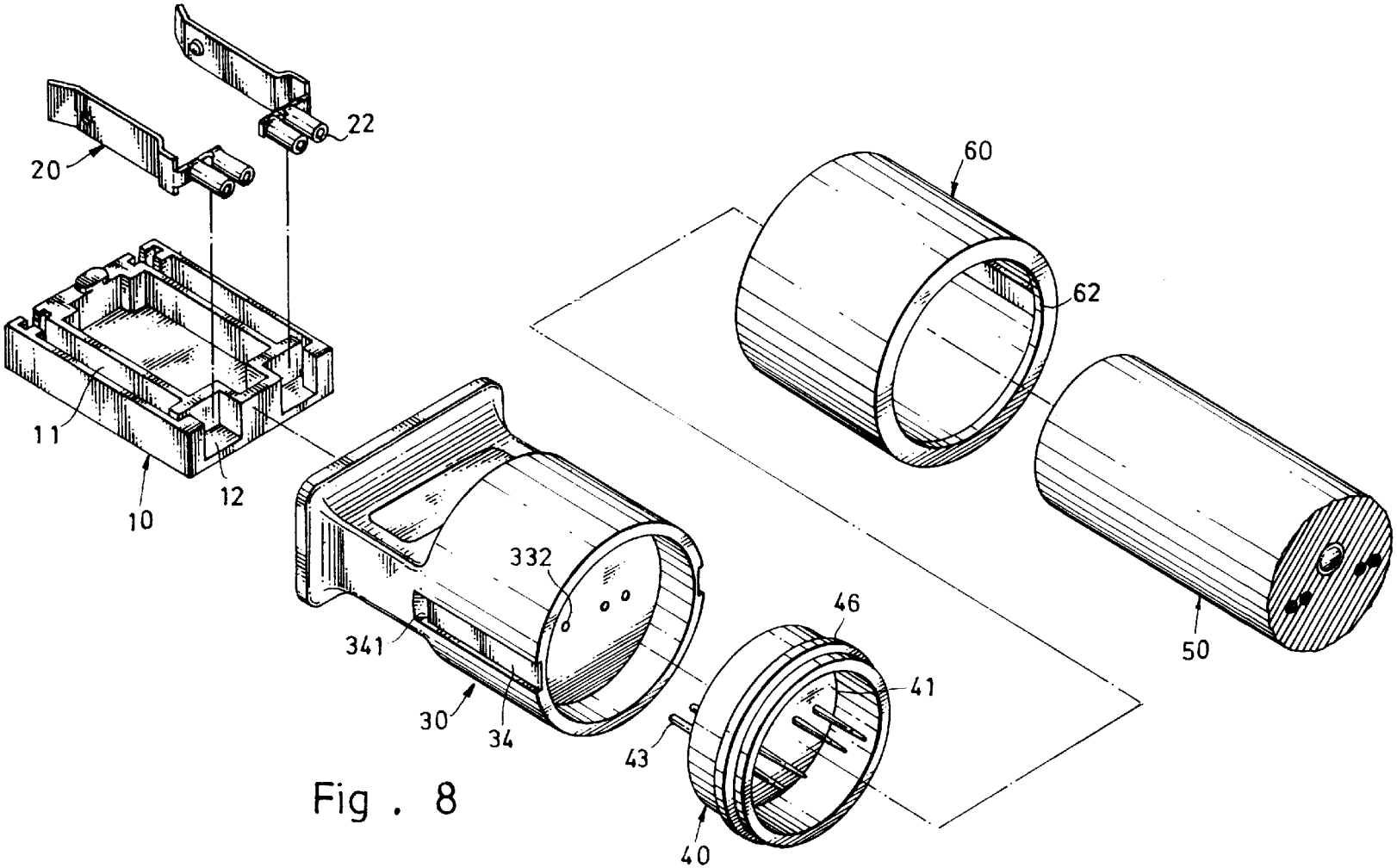
FIG. 8 is similar to the embodiment shown in FIG. 5 but the cartridge fuse excluded.

Referring to FIGS. from 1 through 4, a tubular lamp assembly in accordance with the present invention is shown comprised of a lamp body 50, and an electric plug A connected to one end of the lamp body 50. The lamp body comprises on the inside of the shell thereof a plurality of lamp tubes electrically connected in series, and a plurality of contact holes 51 disposed at one end thereof and adapted to receive the electric plug A. The electric plug A is comprised of a blade holder block 10, two metal blades 20, a housing 30, and a coupler 40. The blade holder block 10 is shaped like a rectangular casing having two blade positioning grooves 11 adapted to receive the metal blades 20, and two pairs of end holes 12 respectively disposed at front and rear sides thereof in communication with two distal ends of each blade positioning groove 11. The metal blades 20 are respectively positioned in the blade positioning grooves 11 of the blade holder block 10 for connection to positive and negative terminals of power source, each having a front end terminating in a front plug portion 21 and extended out of one end hole 12 at the front side of the blade holder block 10 and a rear end terminating in two parallel receiving tubes 22 and extended out of one end hole 12 at the rear side of the blade holder block 10. The housing 30 comprises a rectangular front receiving chamber 31, which receives the blade holder block 10 and the metal blades 20 in the blade holder block 10, a circular rear receiving hole 32, which receives the coupler 40, a partition wall 33, which separates the circular rear receiving hole 32 from the rectangular front receiving chamber 31, four receptacle portions 331 respectively formed integral with the partition wall 33 at one side within the rectangular front receiving chamber 31, which receive the receiving tubes 22 of the metal blades 20, four through holes 332 respectively extended through the partition wall 33 in communication with the receptacle portions 331, two longitudinal locating ribs 321 bilaterally disposed inside the circular rear receiving hole 32, and two recessed portions 322 bilaterally disposed inside the circular rear receiving hole 32 and respectively spaced from the longitudinal locating ribs 321 at an equal distance. The blade holder block 10 is press-fitted into the rectangular front receiving chamber 31, and disposed in flush with the front side of the housing 30. The coupler 40 is shaped like a circular cap covered on one end of the lamp body 50, comprising a rear receiving hole 41, which receives one end of the lamp body 50, four metal contact pins 43 axially extended out of the front side wall 42 and back side wall 411 thereof and respectively plugged through the through holes 332 of the housing 30 into contact with the receiving tubes 22 of the metal blades 20 and the contact holes 51 of the lamp body 50, two longitudinal coupling grooves 44 bilaterally disposed at the periphery thereof and respectively coupled to the longitudinal locating ribs 321 of the housing 30, and two raised portions 45 respectively raised from the periphery and forced into engagement with the recessed portions 322 of the housing 30. Further, a cartridge fuse 23 may be installed in one metal blade 20 and adapted to break the circuit under an overload of current.

The assembly process of the tubular lamp assembly is simple and outlined hereinafter with reference to FIGS. from 1 through 4 again. The metal blades 20 are respectively positioned in the positioning grooves 11 of the blade holder block 10, and then the blade holder block 10 with the metal blades 20 are press-fitted into the rectangular front receiving chamber 31 of the housing 30, enabling the receiving tubes 22 of the metal blades 20 to be respectively plugged into the receptacle portions 331 of the housing 30, and then the coupler 40 is attached to the lamp body 50, enabling the metal contact pins 43 to be respectively plugged into the contact holes 51 of the lamp body 50, and then the coupler 40 is inserted with the lamp body 50 into the circular rear receiving hole 32 of the housing 30 to couple the longitudinal coupling grooves 44 to the longitudinal locating ribs 321 of the housing 30 and to force the metal contact pins 43 into the through holes 332 and the receiving tubes 22 of the metal blades 20 and simultaneously to force the raised portions 45 into engagement with the recessed portions 322 of the housing 30.

FIGS. from 5 through 9 show an alternate form of the present invention. According to this alternate form, the aforesaid longitudinal locating ribs 321 and recessed portions 322 are eliminated from the housing 30; the housing 30 comprises two longitudinal coupling grooves 34 bilaterally disposed at the periphery thereof, and two retaining holes 341 respectively disposed at an inner end of the longitudinal coupling grooves 34; the coupler 40 is coupled between the lamp body 50 and the housing 30, having an outside annular flange 46 stopped outside the housing 30; a cap 60 is covered on the coupler 40 and the housing 30 to secure the coupler 40 and the housing 30 firmly together, having two longitudinal inside coupling ribs 61 respectively inserted into the longitudinal coupling grooves 34 of the housing 30, two hooked portions 611 respectively formed integral with one end of the longitudinal inside coupling ribs 61 and hooked in the retaining holes 341 of the housing 30, and an annular rear locating flange 62 stopped at one side of the outside annular flange 46 of the coupler 40 against the housing 30.

FIGS. from 10 through 15 show another alternate form of the present invention. According to this alternate form, the aforesaid coupler 40 is eliminated, and pointed pins are formed integral with the metal blades 20 instead of the aforesaid receiving tubes 22 and adapted for inserting through the partition wall 33 of the housing 30 into the contact holes 51 of the lamp body 50.

Figure 9:
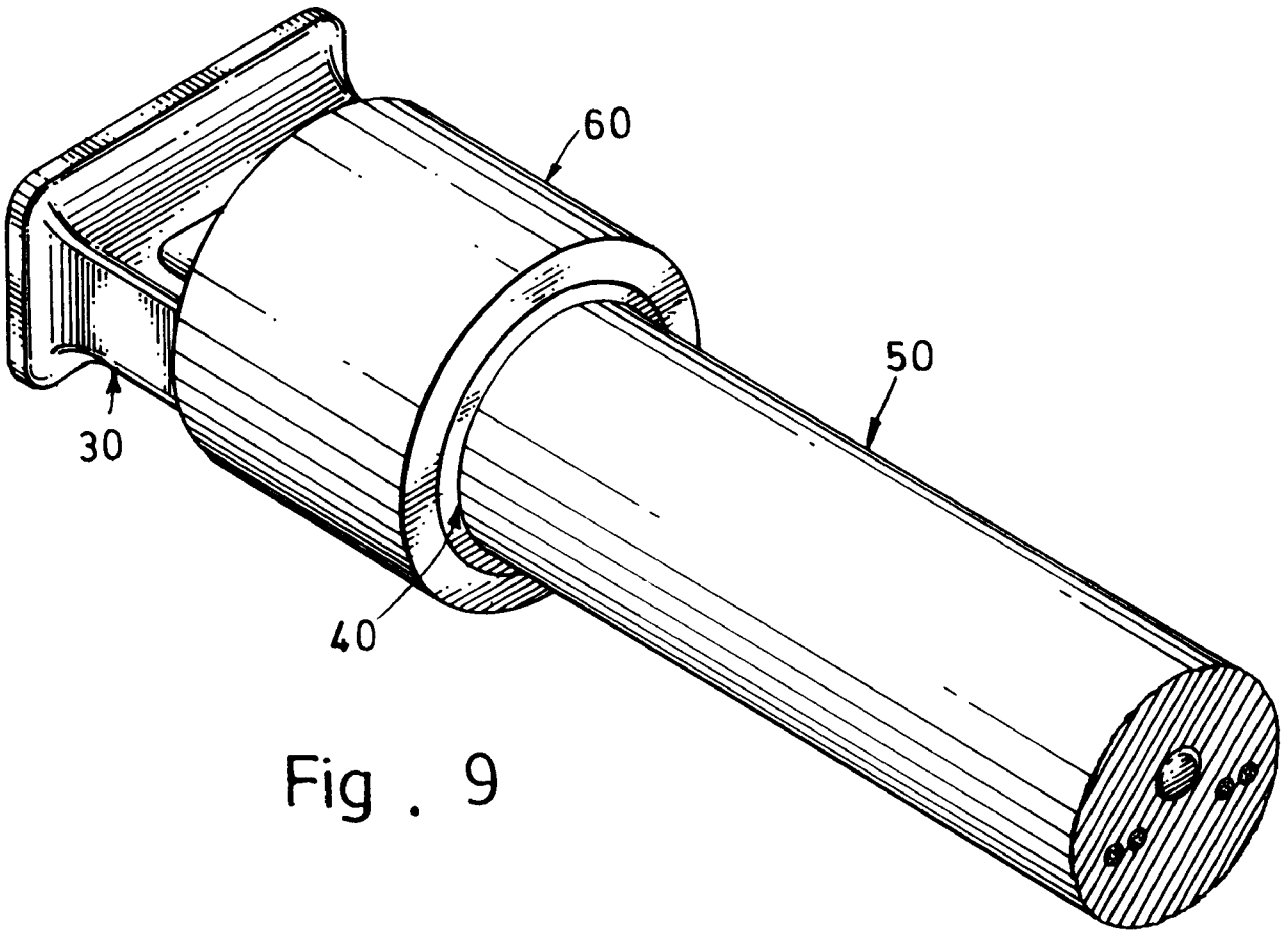
FIG. 9 is similar to FIG. 7 but showing the housing designed for receiving an electric plug.
Figure 10:
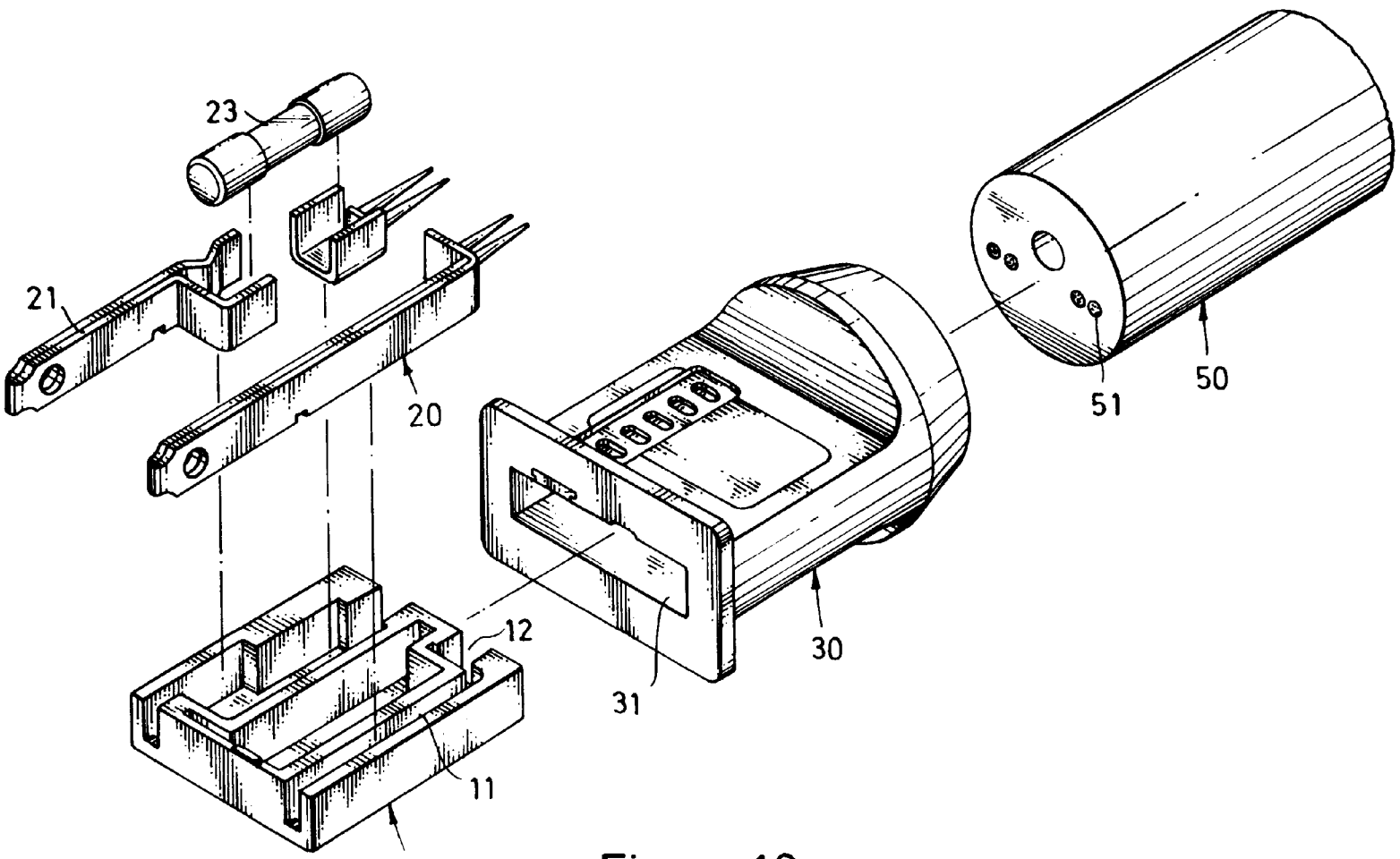
FIG. 10 is an exploded view of another alternate form of the tubular lamp assembly according to the present invention.
Figure 11:
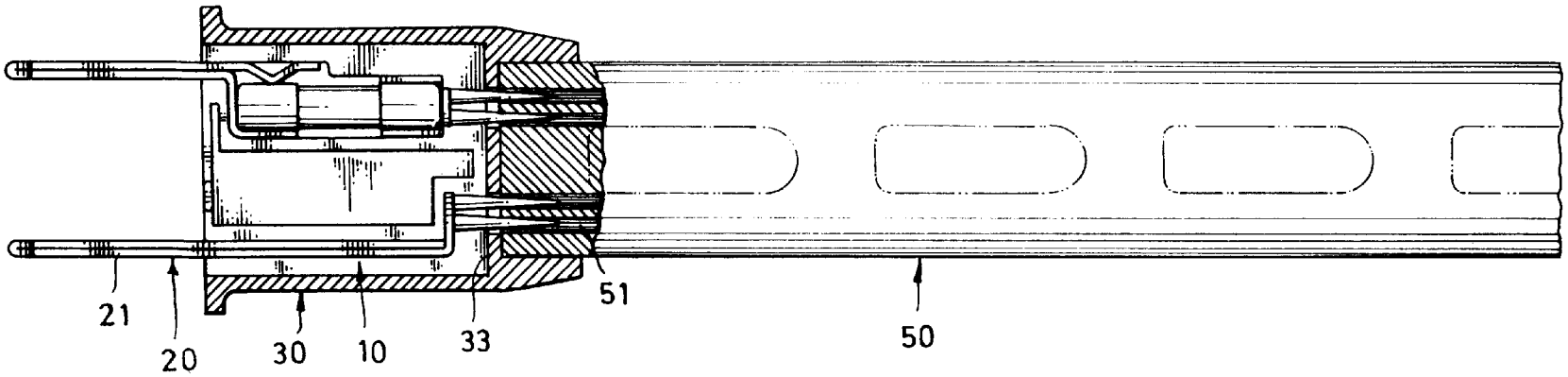
FIG. 11 is a sectional assembly view of the embodiment shown in FIG. 10.
Figure 12:
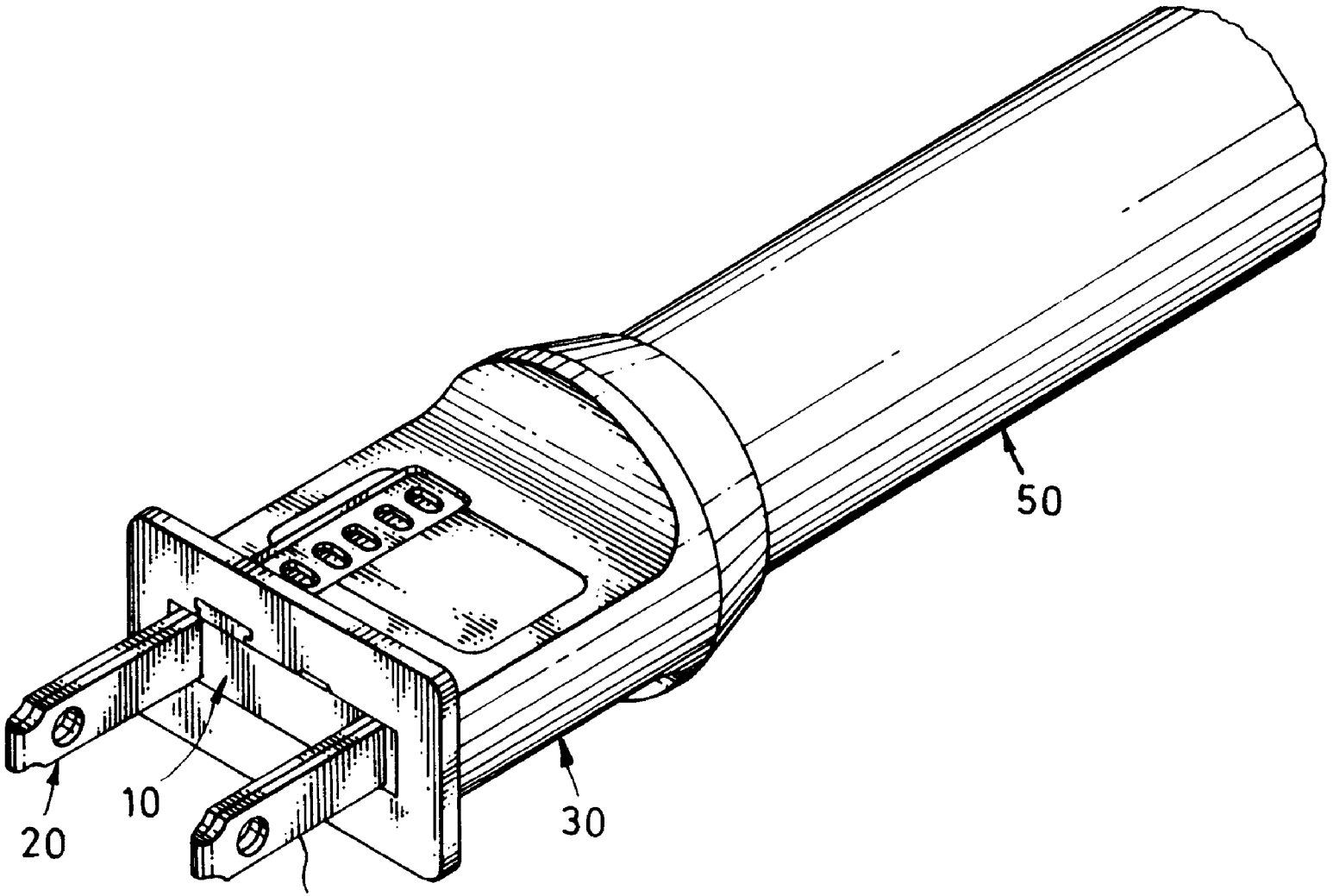
FIG. 12 is an elevational assembly view of the embodiment shown in FIG. 10.
Figure 13:
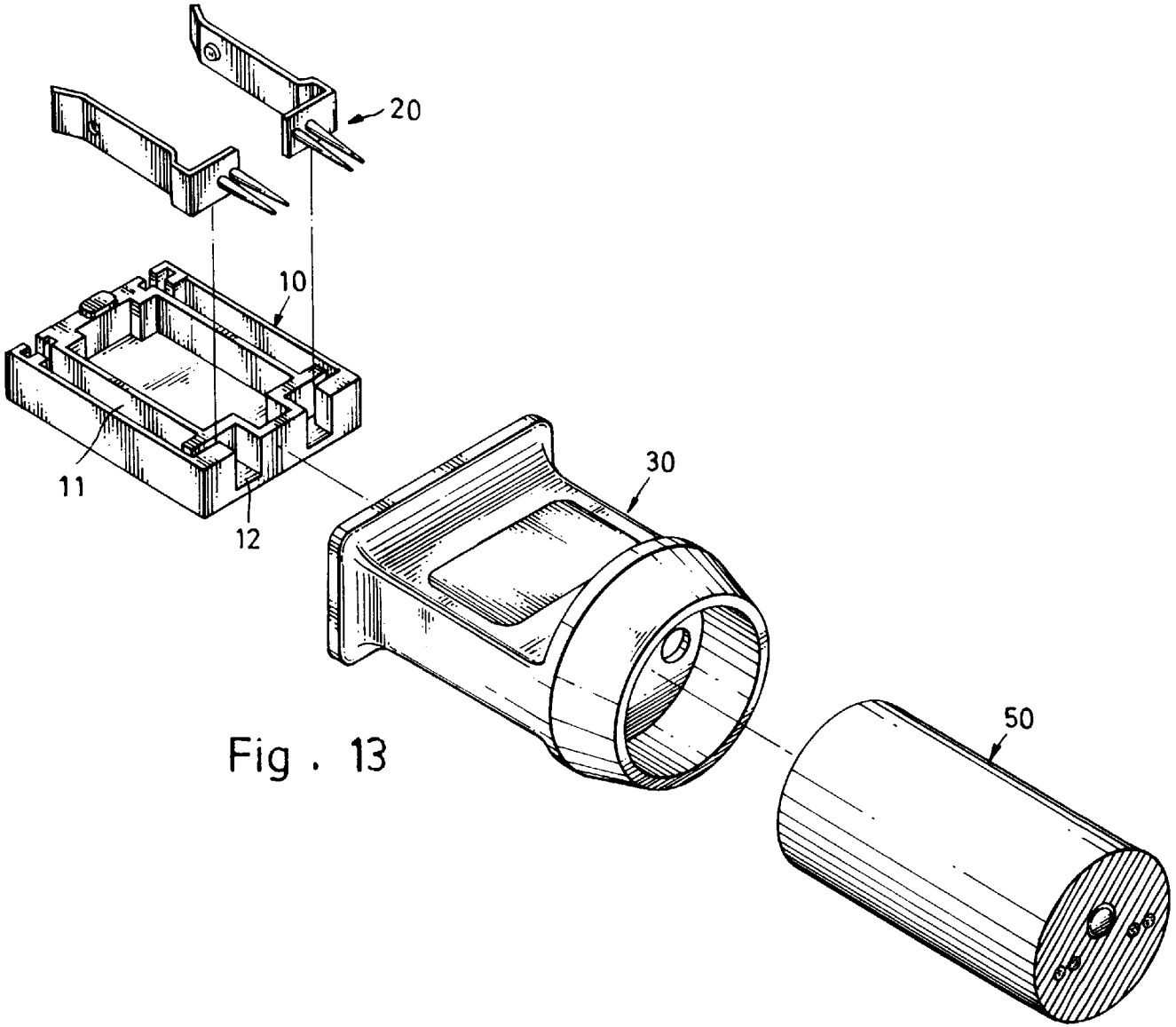
FIG. 13 is similar to the embodiment shown in FIG. 10 but the cartridge fuse excluded.
Figure 14:
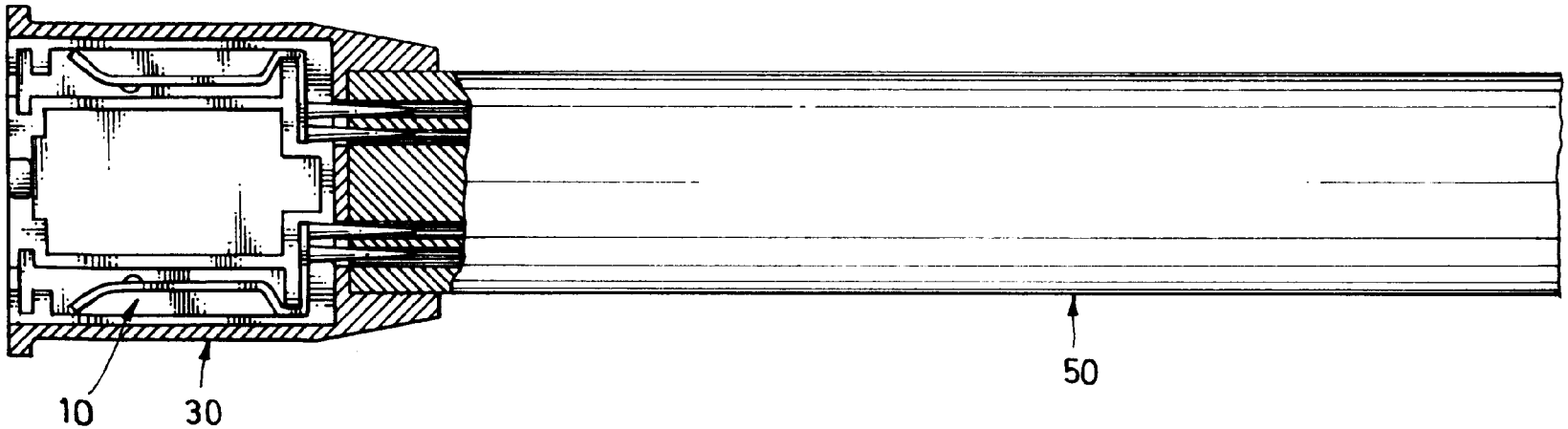
FIG. 14 is a sectional view of the present invention, showing the housing, the blade holder block and the metal blades designed to receive an electric plug.
Figure 15:
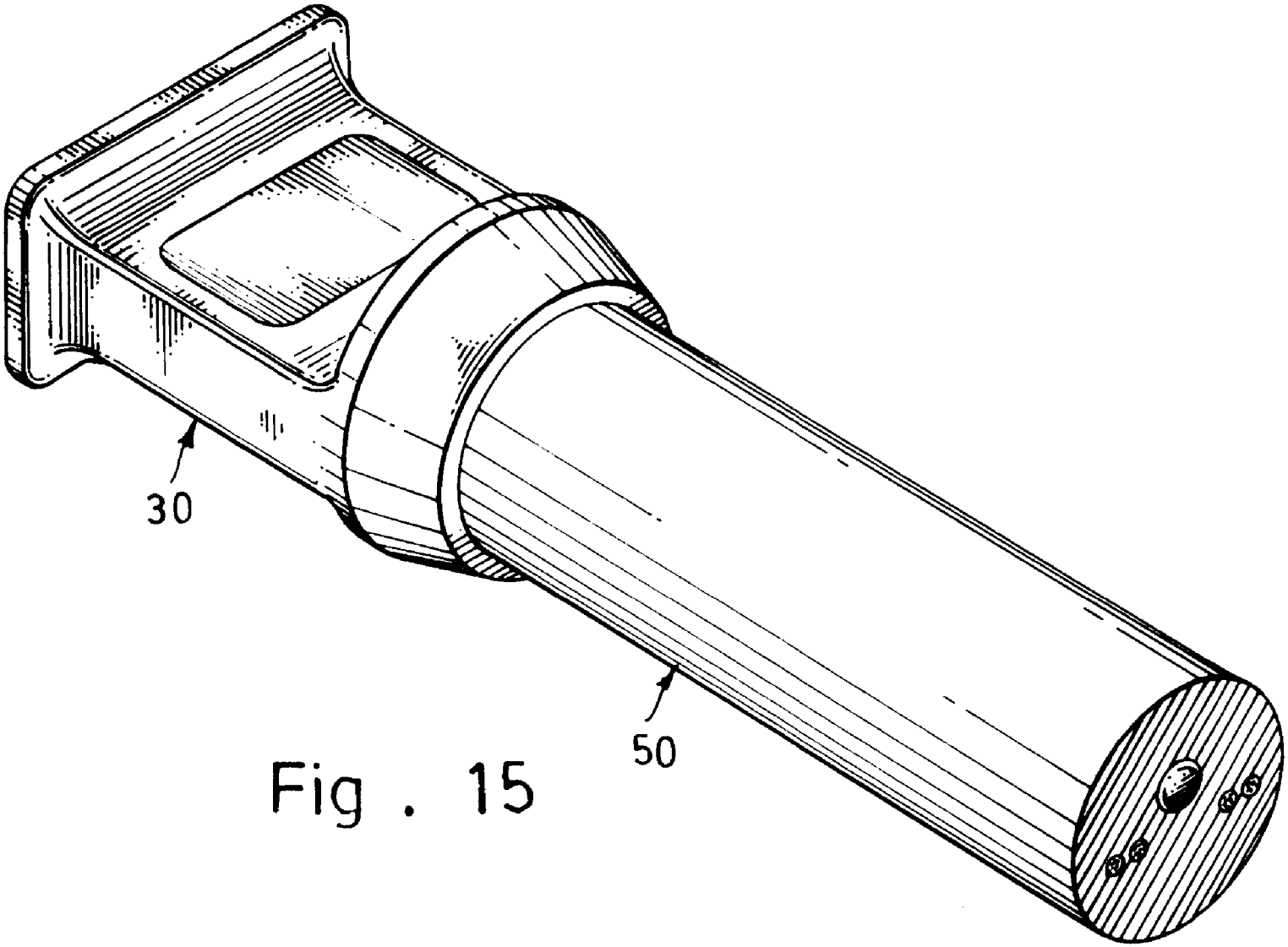
FIG. 15 is an elevational view of the embodiment shown in FIG. 14.
Figure 16:
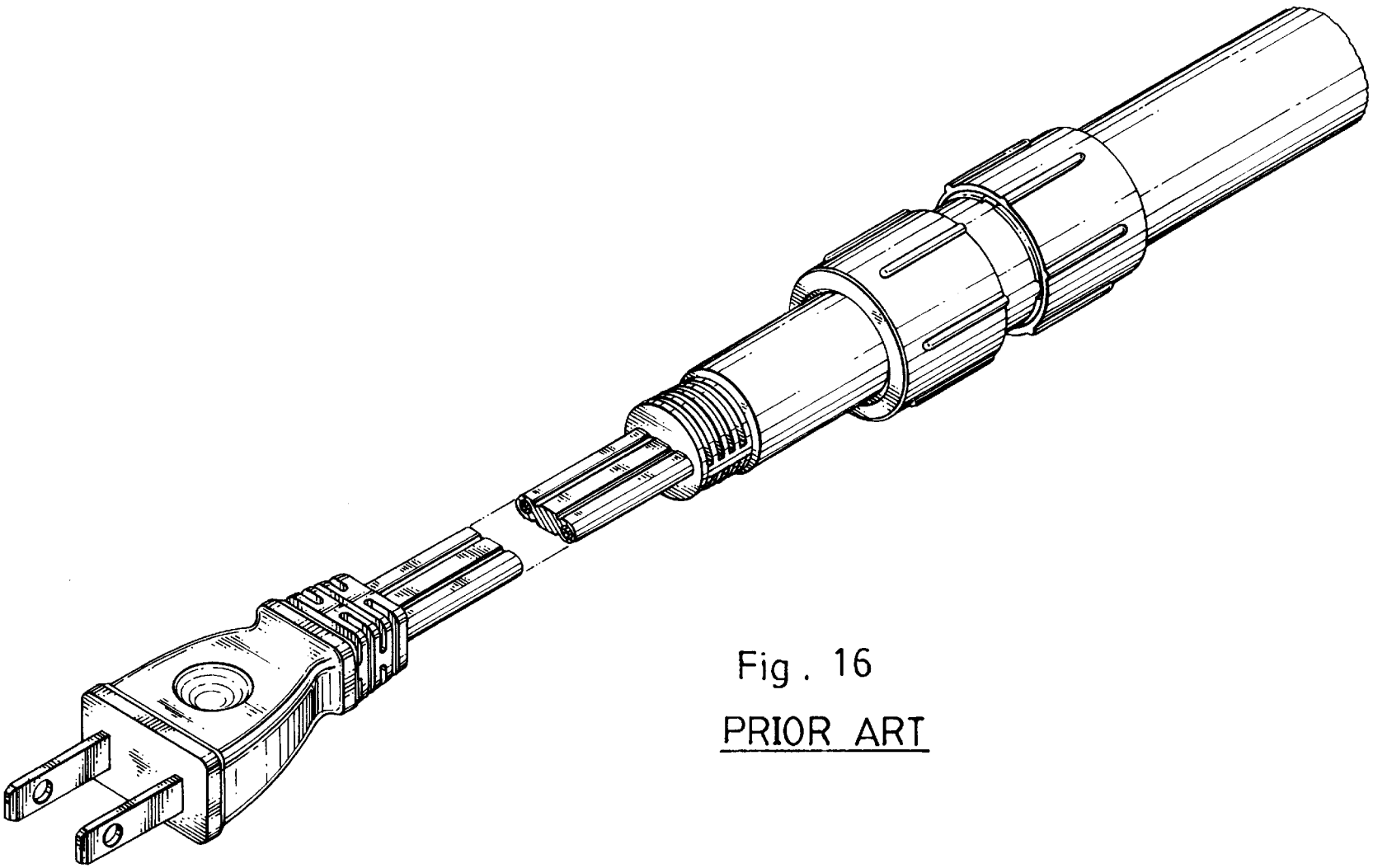
Fig. 16 PRIOR ART
FIG. 16 is an elevational view of a tubular lamp assembly according to the prior art.
Figure 17:
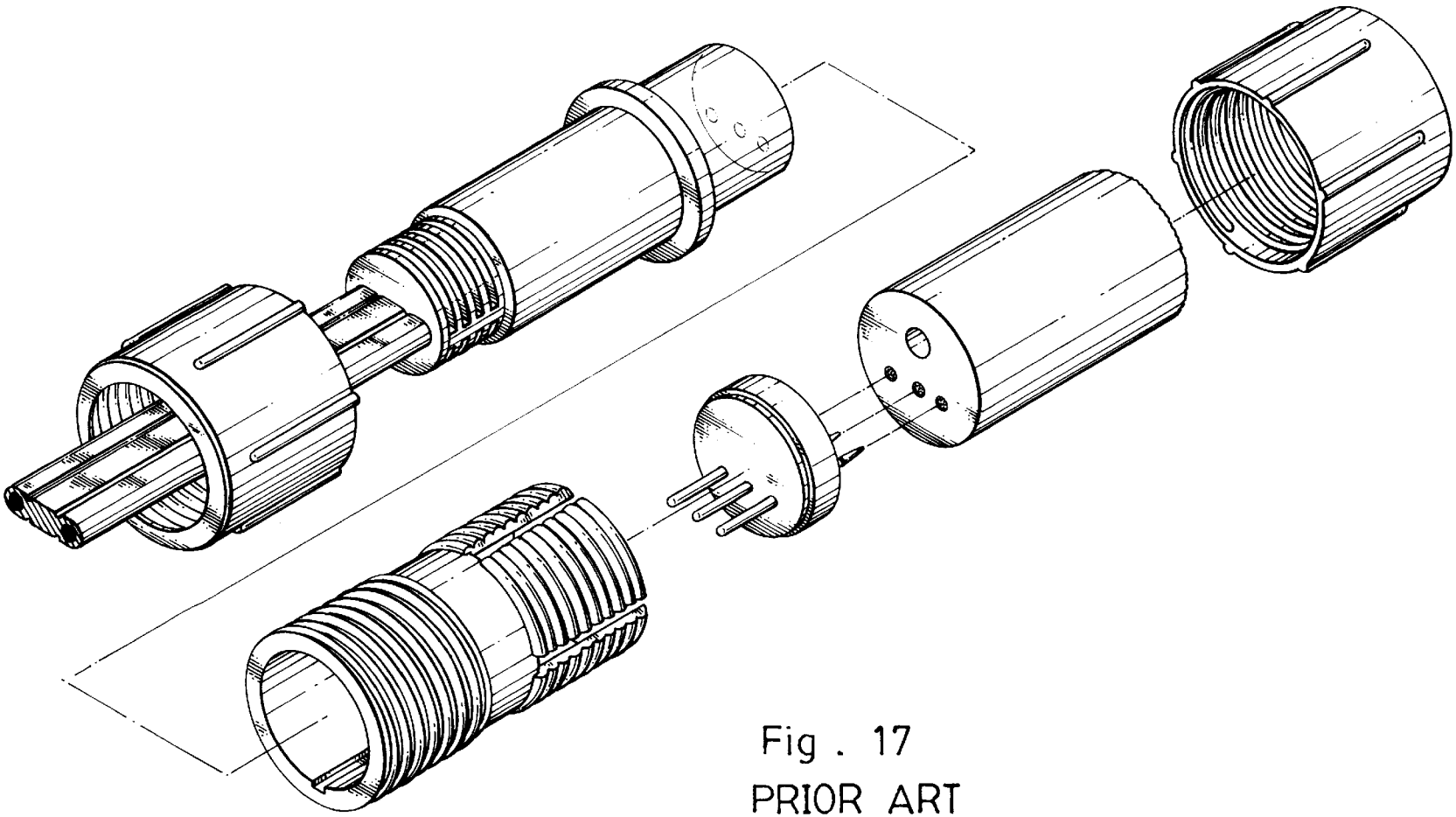
Fig. 17 PRIOR ART
FIG. 17 is an exploded view in an enlarged scale of a part of FIG. 16.

It is to be understood that the drawings are designed for purposes of illustration only, and are not intended for use as a definition of the limits and scope of the invention disclosed. For example, the tubular lamp assembly can be made comprised of a lamp body and an electric socket connected to one end of the lamp body, wherein the electric socket is comprised of a terminal holder block of structure similar to the aforesaid blade holder block, positive and negative terminals respectively installed in the terminal holder block, a housing of structure same as the aforesaid housing and adapted to receive the terminal holder block and the terminals in the terminal holder block, and a coupler of structure same as the aforesaid coupler and coupled between the housing and the lamp body electrically connected between the terminals and the electric contact holes of the lamp body (see FIGS. 9, 14 and 15).

What is claimed is:

1. A tubular lamp assembly comprising a lamp body, said lamp body comprising a plurality of lamp tubes electrically connected in series and arranged inside a shell thereof, and a plurality of electric contact holes disposed at one end thereof, and an electric plug connected to one end of said lamp body and adapted for connecting to an electric socket to transmit power supply to said lamp body, wherein said electric plug comprises:

a blade holder block shaped like a rectangular casing having two front end holes and two rear end holes respectively disposed at front and rear sides thereof, and two blade positioning grooves respectively connected between said front end holes and said rear end holes and arranged in parallel;

two metal blades respectively positioned in the blade positioning grooves of said blade holder block, said metal blades each having a front end terminating in a front plug portion and extended out of one front end hole of said blade holder block and a rear end terminating in at least one receiving tube and extended out of one rear end hole of said blade holder block;

a housing adapted to receive said blade holder block and said metal blades in said blade holder block, said housing comprising a rectangular front receiving chamber, which receives said blade holder block and said metal blades in said blade holder block, a circular rear receiving hole, a partition wall, which separates said circular rear receiving hole from said rectangular front receiving chamber, a plurality of receptacle portions respectively formed integral with said partition wall at one side within said rectangular front receiving chamber and adapted to receive the receiving tubes of said metal blades, a plurality of through holes respectively extended through said partition wall in communication with said receptacle portions, two longitudinal locating ribs bilaterally disposed inside said circular rear receiving hole, and two recessed portions bilaterally disposed inside said circular rear receiving hole and respectively spaced from said longitudinal locating ribs at an equal distance; and a coupler coupled between said housing and said lamp body to connect said metal blades to the electric contact hales of said lamp body, said coupler comprising a rear receiving hole, which receives one end of said lamp body, a plurality of metal contact pins axially extended out of front side wall and back side wall thereof, said metal contact pins each having a front end respectively plugged through the through holes of said housing into contact with the receiving tubes of said metal blades and a rear end respectively plugged into the electric contact holes of said lamp body, two longitudinal coupling grooves bilaterally disposed at the periphery thereof and respectively coupled to the longitudinal locating ribs of said housing, and two raised portions respectively raised from the periphery and forced into engagement with the recessed portions of said housing.

2. The tubular lamp assembly of claim 1 further comprising a cartridge fuse installed in one of said metal blades and adapted to break the circuit under an overload of current.

3. A tubular lamp assembly comprising a lamp body, said lamp body comprising a plurality of lamp tubes electrically connected in series and arranged inside a shell thereof, and a plurality of electric contact holes disposed at one end thereof, and an electric plug connected to one end of said lamp body and adapted for connecting to an electric socket to transmit power supply to said lamp body, wherein said electric plug comprises:

a blade holder block shaped like a rectangular casing having two front end holes and two rear end holes respectively disposed at front and rear sides thereof, and two blade positioning grooves respectively connected between said front end holes and said rear end holes and arranged in parallel;

two metal blades respectively positioned in the blade positioning grooves of said blade holder block and connected to the electric contact holes of said lamp body, said metal blades each having a front end terminating in a front plug portion and extended out of one front end hole of said blade holder block and a rear end terminating in at least one pointed pin extended out of one rear end hole of said blade holder block and adapted for fastening to the electric contact holes of said lamp body; and a housing adapted to receive said blade holder block and said metal blades in said blade holder block, said housing comprising a rectangular front receiving chamber, which receives said blade holder block and said metal blades in said blade holder block, a circular rear receiving hole, a partition wall, which separates said circular rear receiving hole from said rectangular front receiving chamber, a plurality of through holes through which the pointed pins of said metal blades pass, two longitudinal locating ribs bilaterally disposed inside said circular rear receiving hole, and two recessed portions bilaterally disposed inside said circular rear receiving hole and respectively spaced from said longitudinal locating ribs at an equal distance.

4. The tubular lamp assembly of claim 3 further comprising a cartridge fuse installed in one of said metal blades and adapted to break the circuit under an overload of current.

5. A tubular lamp assembly comprising a lamp body, said lamp body comprising a plurality of lamp tubes electrically connected in series and arranged inside a shell thereof, and a plurality of electric contact holes disposed at one end thereof, and an electric plug connected to one end of said lamp body and adapted for connecting to an electric socket to transmit power supply to said lamp body, wherein said electric plug comprises:

a blade holder block shaped like a rectangular casing having two front end holes and two rear end holes respectively disposed at front and rear sides thereof, and two blade positioning grooves respectively connected between said front end holes and said rear end holes and arranged in parallel;

two metal blades respectively positioned in the blade positioning grooves of said blade holder block, said metal blades each having a front end terminating in a front plug portion and extended out of one front end hole of said blade holder block and a rear end terminating in at least one receiving tube and extended out of one rear end hole of said blade holder block;

a housing adapted to receive said blade holder block and said metal blades in said blade holder block, said housing comprising a rectangular front receiving chamber, which receives said blade holder block and said metal blades in said blade holder block, a circular rear receiving hole, a partition wall, which separates said circular rear receiving hole from said rectangular front receiving chamber, a plurality of receptacle portions respectively formed integral with said partition wall at one side within said rectangular front receiving chamber and adapted to receive the receiving tubes of said metal blades, a plurality of through holes respectively extended through said partition wall in communication with said receptacle portions, two retaining holes disposed at the periphery thereof at two opposite sides, two longitudinal coupling grooves disposed at the periphery and respectively extended from said retaining holes to a rear side thereof;

a coupler coupled between said lamp body and said housing and press-fitted into the circular rear receiving hole of said housing, said coupler comprising an outside annular flange stopped outside said housing, and a plurality of metal contact pins axially extended out of front side wall and back side wall thereof, said metal contact pins each having a front end respectively plugged through the through holes of said housing into contact with the receiving tubes of said metal blades and a rear end respectively plugged into the electric contact holes of said lamp body; and a cap covered on said coupler and said housing to secure said coupler and said housing together, said cap comprising two longitudinal inside coupling ribs respectively inserted into the longitudinal coupling grooves of said housing, two hooked portions respectively hooked in the retaining holes of said housing, and an annular rear locating flange stopped at one side of said outside annular flange of said coupler against said housing.

6. The tubular lamp assembly of claim 5 further comprising a cartridge fuse installed in one of said metal blades and adapted to break the circuit under an overload of current.

7. A tubular lamp assembly comprising a lamp body, said lamp body comprising a plurality of lamp tubes electrically connected in series and arranged inside a shell thereof, and a plurality of electric contact holes disposed at one end thereof and an electric socket connected to one end of said lamp body and adapted for connecting to an electric plug, wherein said electric socket comprises:

a terminal holder block shaped like a rectangular casing, said terminal holder block comprising two front end holes and two rear end holes respectively disposed at front and rear sides thereof, and two terminal positioning grooves respectively connected between said front end holes and said rear end holes and arranged in parallel;

two metal contact terminals respectively positioned in the terminal positioning grooves of said terminal holder block, said metal contact terminals each having a front end respectively suspended in the front end holes of said terminal holder block and adapted for receiving metal blades of an electric plug, and a rear end terminating in at least one receiving tube and respectively extended out of the rear end holes of said terminal holder block;

a housing adapted to receive said terminal holder block and said metal contact terminal in said terminal holder block, said housing comprising a rectangular front receiving chamber, which receives said terminal holder block and said metal contact terminals in said terminal holder block, a circular rear receiving hole, a partition wall, which separates said circular rear receiving hole from said rectangular front receiving chamber, a plurality of receptacle portions respectively formed integral with said partition wall at one side within said rectangular front receiving chamber and adapted to receive the receiving tubes of said metal contact terminals, a plurality of through holes respectively extended through said partition wall in communication with said receptacle portions, two longitudinal locating ribs bilaterally disposed inside said circular rear receiving hole, and two recessed portions bilaterally disposed inside said circular rear receiving hole and respectively spaced from said longitudinal locating ribs at an equal distance; and a coupler coupled between said housing and said lamp body to connect said metal contact terminals to the electric contact holes of said lamp body, said coupler comprising a rear receiving hole, which receives one end of said lamp body, a plurality of metal contact pins axially extended out of front side wall and back side wall thereof said metal contact pins each having a front end respectively plugged through the through holes of said housing into contact with the receiving tubes of said metal contact terminals and a rear end respectively plugged into the electric contact holes of said lamp body, two longitudinal coupling grooves bilaterally disposed at the periphery thereof and respectively coupled to the longitudinal locating ribs of said housing, and two raised portions respectively raised from the periphery and forced into engagement with the recessed portions of said housing.

8. The tubular lamp assembly of claim 7 further comprising a cartridge fuse installed in one of said metal terminals and adapted to break the circuit under an overload of current.

* * * * *